US010935257B2

(12) United States Patent
Jung et al.

(10) Patent No.: US 10,935,257 B2
(45) Date of Patent: Mar. 2, 2021

(54) CONTROL BOX AND WINDOW TYPE AIR CONDITIONER INCLUDING THE SAME

(71) Applicant: LG ELECTRONICS INC., Seoul (KR)

(72) Inventors: Seenchul Jung, Seoul (KR); Sungho Seo, Seoul (KR); Hyeongrok Heo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 483 days.

(21) Appl. No.: 15/889,938

(22) Filed: Feb. 6, 2018

(65) Prior Publication Data

US 2019/0024910 A1 Jan. 24, 2019

(30) Foreign Application Priority Data

Jul. 21, 2017 (KR) ..... 10-2017-0092749

(51) Int. Cl.
*F24F 1/027* (2019.01)
*F24F 13/20* (2006.01)

(52) U.S. Cl.
CPC ..... *F24F 1/027* (2013.01); *F24F 2013/207* (2013.01)

(58) Field of Classification Search
CPC ..... B65D 79/0084; F24F 1/027; F24F 1/24
USPC ..... 454/184, 204; 165/104.33
See application file for complete search history.

(56) References Cited

U.S. PATENT DOCUMENTS

2017/0205086 A1* 7/2017 Yanase ..... F24F 1/24

FOREIGN PATENT DOCUMENTS

KR 10-2005-0104737 A 11/2005

* cited by examiner

*Primary Examiner* — Vivek K Shirsat
(74) *Attorney, Agent, or Firm* — Dentons US LLP

(57) ABSTRACT

A window type air conditioner including a control box. The control box includes a PCB assembly including a heat generation component and a heat dissipation plate, which are disposed on a bottom surface of a board, a PCB support part supporting a lower portion of the board and having a support partition part disposed between the heat generation component and the heat dissipation plate, and a box case having an inner space in which the support partition part is seated, and the heat generation component is accommodated. The heat dissipation plate is disposed outside the box case.

19 Claims, 15 Drawing Sheets

CONTROL BOX AND WINDOW TYPE AIR CONDITIONER INCLUDING THE SAME

CROSS-REFERENCE TO RELATED APPLICATIONS

The present application claims priority under 35 U.S.C. § 119 and 35 U.S.C. § 365 to Korean Patent Application No. 10-2017-0092749 (filed on Jul. 21, 2017), which is hereby incorporated by reference in its entirety.

BACKGROUND

The present disclosure relates to a control box and a window type air conditioner including the same.

Air conditioners are devices that cool or heat an indoor space by using a refrigeration cycle. The refrigeration cycle includes a compressor, a condenser, an expansion device, and an evaporator. A refrigerant circulated through these components, which are successively connected to each other via tubing.

Air conditioners are generally classified into either split type air conditioners or window type air conditioners.

A split type air conditioner typically includes an indoor unit installed in an indoor space to discharge conditioned air into the indoor space and an outdoor unit connected to the indoor unit through tubes and installed in an outdoor space. A heat exchanger may be provided in each of the outdoor unit and the indoor unit. The indoor unit includes an indoor heat exchanger, and the outdoor unit includes a compressor and an outdoor heat exchanger. When the air conditioner performs a cooling operation, the outdoor heat exchanger serves as a condenser, and the indoor heat exchanger serves as an evaporator. Alternatively, when the air conditioner performs a heating operation, the indoor heat exchanger serves as a condenser, and the outdoor heat exchanger serves as an evaporator.

A window type air conditioner typically includes a condenser and an evaporator that are installed together inside a case. The condenser is disposed at an outdoor side of the case to heat-exchange with external air, and the evaporator is disposed at an indoor side to heat-exchange with indoor air. The indoor air may be discharged into the indoor space after being cooled in the evaporator.

Korean Patent Publication Number 10-2005-0104737 (filed Apr. 29, 2004) discloses a conventional air conditioner having certain limitations. One such limitation, for example, is that a control box in which control components for controlling an operation of the air conditioner is installed at the indoor side, and thus, heat generated in the control box is introduced into the indoor space to deteriorate cooling efficiency in the indoor space. Another limitation, for example, is that a board disposed on the control box may be shaken or separated by vibration due to the operation of a compressor and a fan motor of the air conditioner. Yet another limitation, for example, is that condensed water scattered by an operation of a blower fan of the air conditioner may be permeated into the control box.

The present application provides an improved design for an a window type air conditioner and is directed to solving at least the above described problems.

SUMMARY

The present invention has been made in order to solve at least the above problems associated with the conventional technology.

Embodiments of the present disclosure provide a window type air conditioner in which heat of a control component provided in a control box to perform an inverter control is easily released, and a spatial utilization is improved.

Embodiments of the present disclosure also provide a window type air conditioner in which effects of elements of a PCB assembly by suctioned outdoor air are reduced, and accumulation of dusts, which are contained in the suctioned indoor air, on the PCB assembly is minimized.

Embodiments of the present disclosure also provide a window type air conditioner in which a PCB support part, to which a PCB assembly is coupled, is stably coupled to the inside of a box case, and when shaking due to vibration of a compressor or a fan motor occurs, the PCB assembly is stably supported without being separated.

Embodiments of the present disclosure also provide a window type air conditioner in which a phenomenon, in which a wire comes into contact with a surface of the control box having a relatively high temperature, is prevented.

Embodiments of the present disclosure also provide a window type air conditioner in which permeation of condensed water, which is scattered by an operation of a blower fan, into a control box is prevented.

According to one embodiment of the present disclosure, a control box includes: a PCB assembly including a heat generation component and a heat dissipation plate, which are disposed on a bottom surface of a board; a PCB support part supporting a lower portion of the board and having a support partition part disposed between the heat generation component and the heat dissipation plate; and a box case having an inner space in which the support partition part is seated, and the heat generation component is accommodated, wherein the heat dissipation plate is disposed outside the box case.

The PCB support part may include: an upper part having an opened top surface; a side part extending downward from the upper part; and a first accommodation part provided between the side part and the support partition part to accommodate the heat generation component.

The box case may have an opened case top part, and the support partition part and the side part may be disposed in the inner space through the case top part. Here, the support partition part may extend downward from the top part, and the side part may be disposed to face the support partition part.

The PCB support part may further include a second accommodation part in which the heat dissipation plate is accommodated, and the first and second accommodation parts may be partitioned by the support partition part. Also, the upper part may include: a first upper part surrounding the heat generation component; and a second upper part surrounding the heat dissipation plate, wherein the support partition part may be disposed between the first and second upper parts.

The control box may further include a PCB coupling part disposed on an inner surface of the first or second upper part and coupled to the board through a coupling member. Also, a support rib protruding from the inner surface of the first or second upper part to support the board may be further provided on the inner surface of the first or second upper part.

A lead-out opening through which a wire connected to the PCB assembly is led out to the outside of the PCB support part may be defined in the side part, and a wire penetration part through which the wire led out through the lead-out opening is led out to the outside of the box case may be provided in the box case.

The box case may include a case heat releasing hole through which heat generated in the PCB assembly is released to the outside, and the PCB support part may include a cutoff part provided by cutting at least a portion of a surface facing the case heat releasing hole.

The control box may further include a box cover coupled to an upper portion of the box case, wherein the box cover may cover the opened top surface of the PCB support part.

The details of one or more embodiments are set forth in the accompanying drawings and the description below. Other features will be apparent from the description and drawings, and from the claims.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part thereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
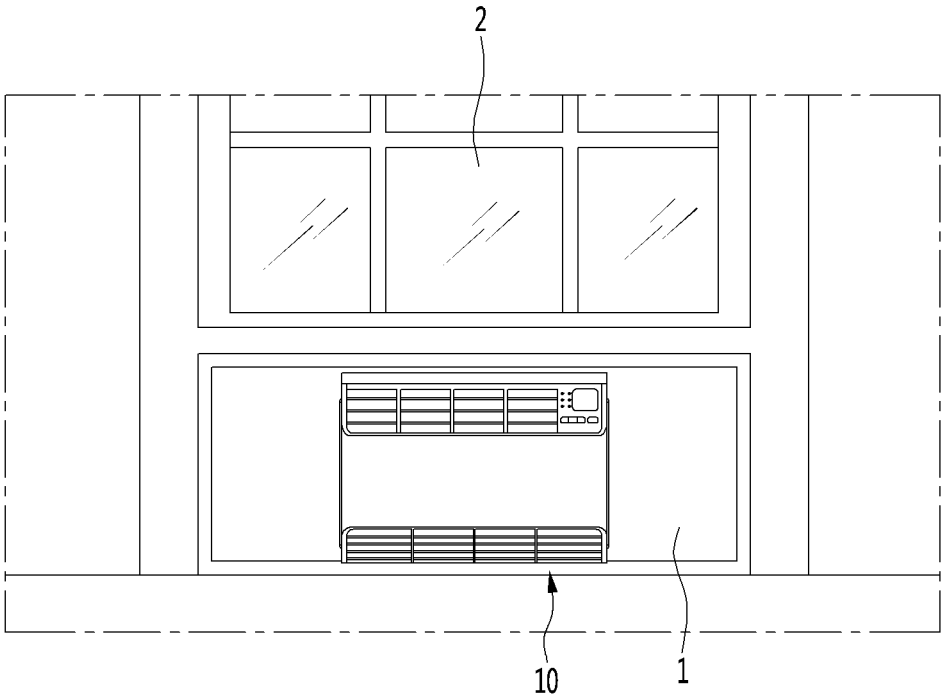
FIG. 1 is a view illustrating an air conditioner is installed on a wall according to an embodiment of the invention.
Figure 2:
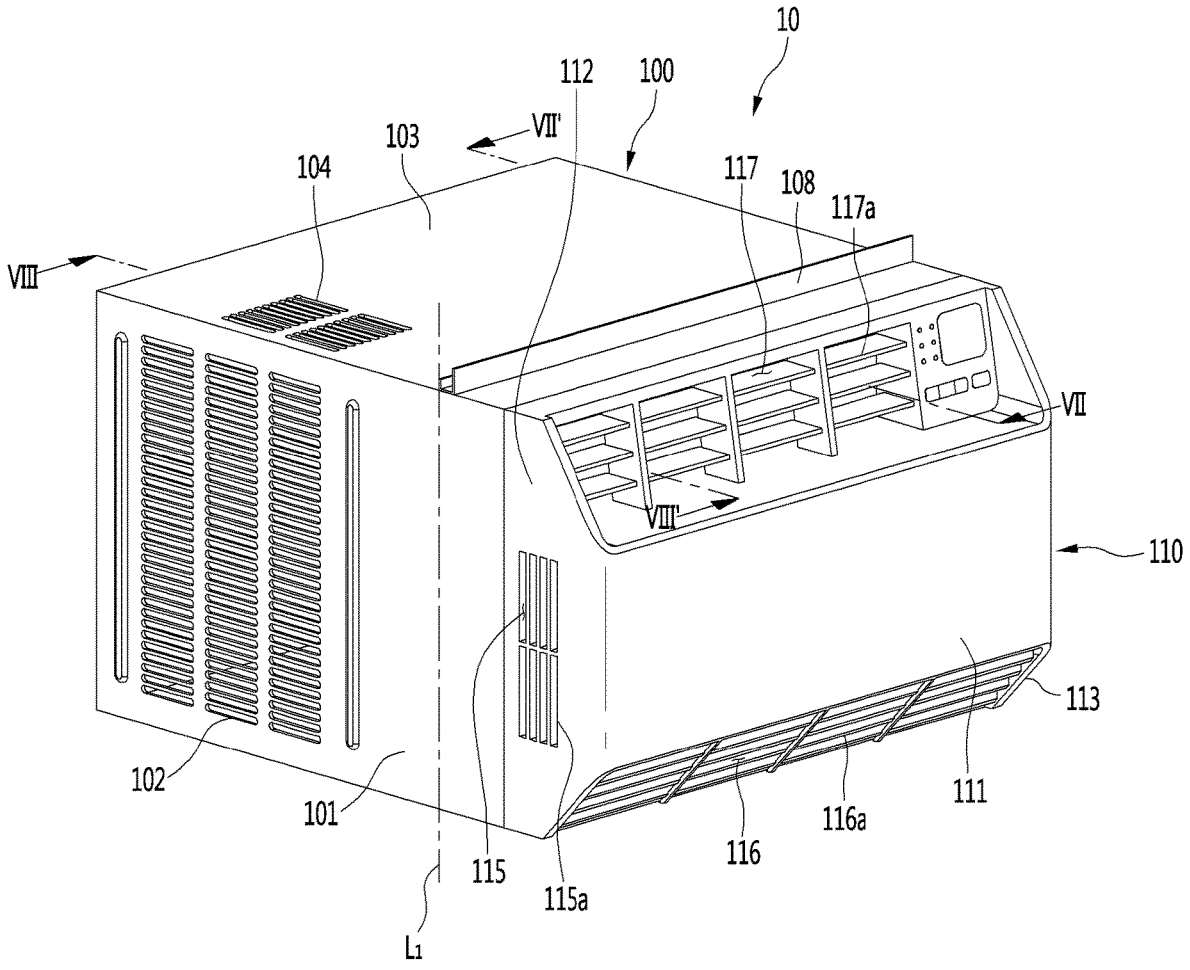
FIG. 2 is a perspective view illustrating an outer appearance of the air conditioner according to an embodiment of the invention.

FIG. 1 is a view illustrating an air conditioner that is installed on a wall according to an embodiment of the invention. FIG. 2 is a perspective view illustrating an outer appearance of the air conditioner according to an embodiment of the invention.

[Air Conditioner Installed on Wall or Window]

Referring to FIG. 1, a window type air conditioner 10 (hereinafter, referred to as an air conditioner) may be installed on a wall 1 or at a window 2 of a building or dwelling. For example, FIG. 1 illustrates a state in which a hole is formed in the wall 1 to install the air conditioner 10 in the building having the wall 1 and the window 2. Alternatively, as illustrated in the drawings, an installation space may be provided in a region in which the window 2 is disposed to install the air conditioner 10 in the installation space.

[Case]

Referring to FIG. 2, the air conditioner 10 may have a hexahedral shape, or an approximately hexahedral shape (not limited thereto). More specifically, the air conditioner 10 may include a case 100 having a hexahedral space with a front portion that is open so as to form an inner space. The case 100 may include a case side part 101 having an outdoor suction part 102 through which outdoor air is suctioned and a case top part 103 disposed or provided on an upper portion of the case side part 101 and having heat releasing holes 104 through which heat generated in the case 100 is released.

The case side part 101 may be disposed or provided on each of both sides of the case 100 (opposite sides, e.g., right and left sides), and the outdoor suction part 102 may be disposed or provided on each of both the case side parts 101.

The outdoor suction part 102 may include a plurality of first through-holes in which at least a portion of the case side part 101 is received or penetrated. The heat releasing holes 104 may include a plurality of second through-holes in which at least a portion of the case top part 103 is received or penetrated.

An installation bracket 108 that is configured to be installed on the wall 1 or at the window 2 may be provided at the case top part 103. The air conditioner 10 may be supported or secured on the wall 1 or at the window 2 through the installation bracket 108.

A front portion of the case side part 101 may be disposed or provided in an indoor space, and a rear portion may be disposed or provided at the wall 1 or in an outdoor space. By way of example, a boundary line that separates the front portion and the rear portion is displayed as reference symbol "L1" in FIG. 2. A rear panel having an outdoor discharge part 109 (see FIG. 13) through which outdoor-side air is discharged may be provided in the rear portion of the case 100. The rear portion 100 is opposite the front portion and adjacent the case side parts 101.

The case 100 may further include a case bottom part 105 defining a bottom surface of the case 100. For example, a main body 120 may be accommodated in the case bottom part 105. For example, a base 121 of the main body 120 may be seated or provided on the case bottom part 105.

[Front Panel]

The air conditioner 10 may further include a front panel 110 disposed or provided at a front portion of the case 100. The front panel 110 may have a plurality of indoor suction parts 115 and 116 and a discharge part 117.

The front panel 110 may include a panel front part 111 that forms a front surface of the air conditioner 10, a panel side part 112 that extends backward from each of both side ends (opposite side ends, e.g., right and left side ends) of the panel front part 111, and a panel bottom part 113 that extends backward from a lower end of the panel front part 111.

The plurality of indoor suction parts 115 and 116 include a first suction part 115 provided at the panel side part 112. The first suction part 115 may be provided at each of both the panel side parts 112. A first suction grill 115*a* may be provided at the panel side part 112. The first suction grill 115*a* may define or form the first suction part 115.

The plurality of indoor suction parts 115 and 116 may include a second suction part 116 provided at the panel bottom part 113. A second suction grill 116*a* may be provided at the panel bottom part 113. The second suction grill 116*a* may define or form the second suction part 116.

The discharge part 117 may be provided at an upper portion of the front panel 110. A discharge grill 117*a* may be provided at the upper portion of the panel front part 111. The discharge grill 118*a* may define or form the discharge part 117.

Air suctioned from both left and right sides of the front panel 110 through the first suction parts 115 and air suctioned from the lower portion of the front panel 110 through the second suction part 116 may pass or flow through the main body 120 (shown in FIG. 3) provided in the case 100 and then be discharged through the discharge part 117.

A display part for displaying operation information of the air conditioner 10 and a display device 118 including an input part for inputting an operation command may be disposed or provided at the upper portion of the front panel 110. For example, as shown in FIG. 3, the display device 119 may be disposed or provided at a side of the discharge part 117.

Figure 3:
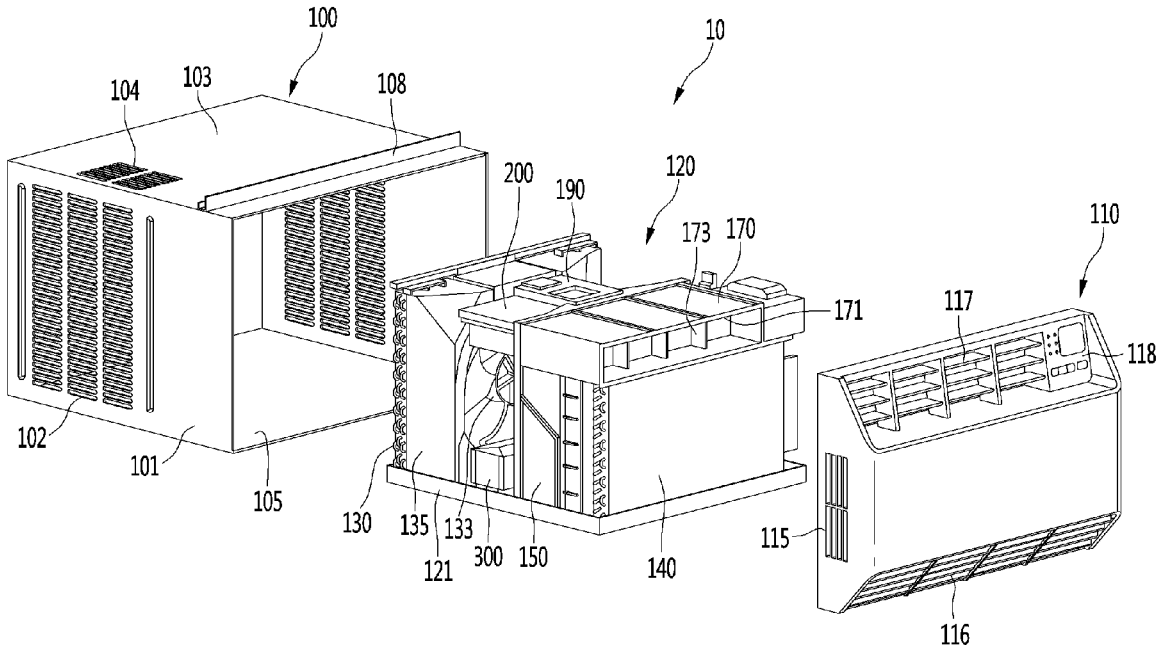
FIG. 3 is an exploded perspective view illustrating constituents of the air conditioner according to an embodiment of the invention.
Figure 4:
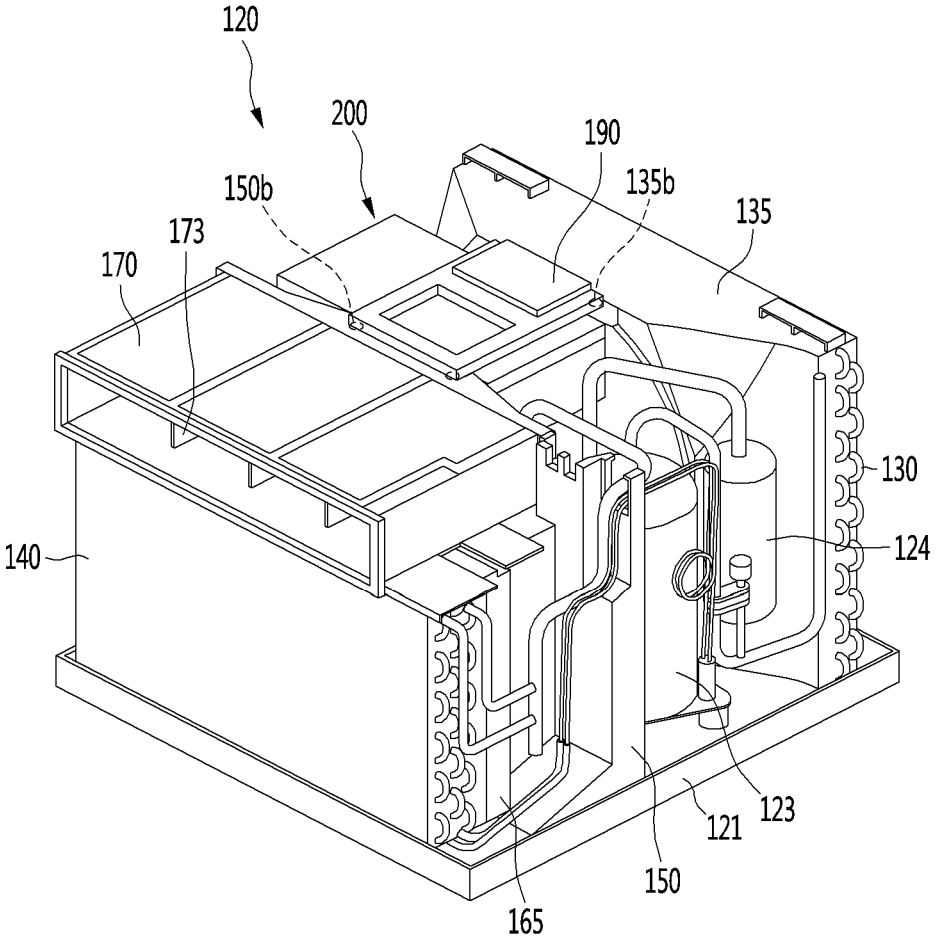
FIG. 4 is a perspective view illustrating constituents of a main body of the air conditioner according to an embodiment of the invention.
Figure 5:
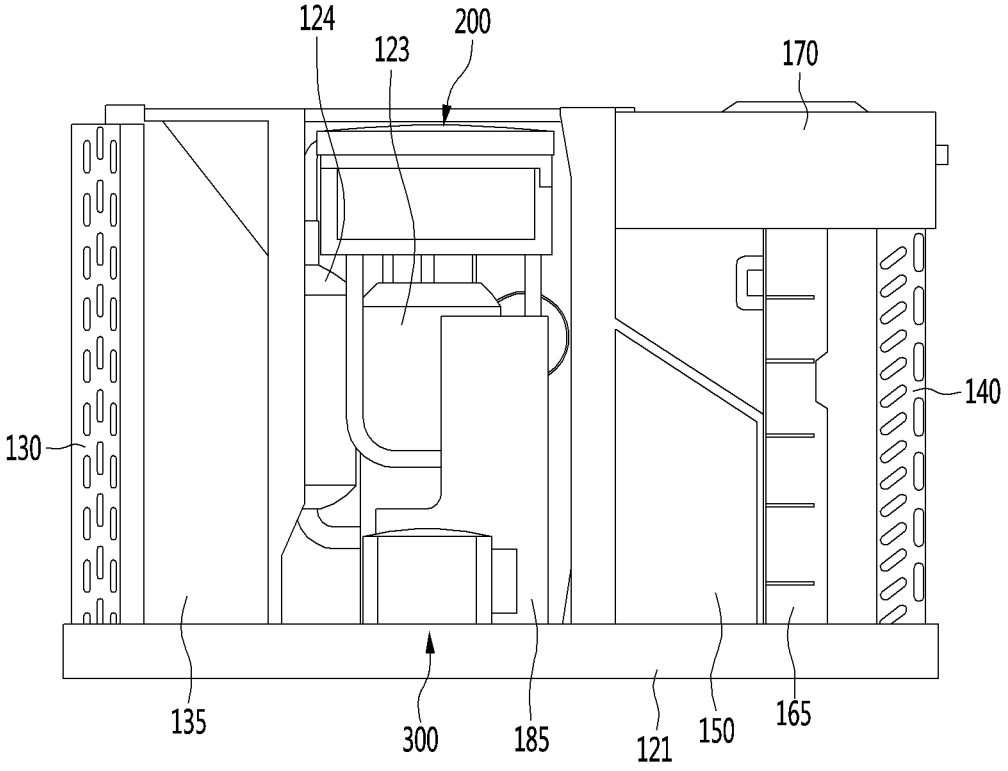
FIG. 5 is a side view illustrating the constituents of the main body according to an embodiment of the invention.
Figure 6:
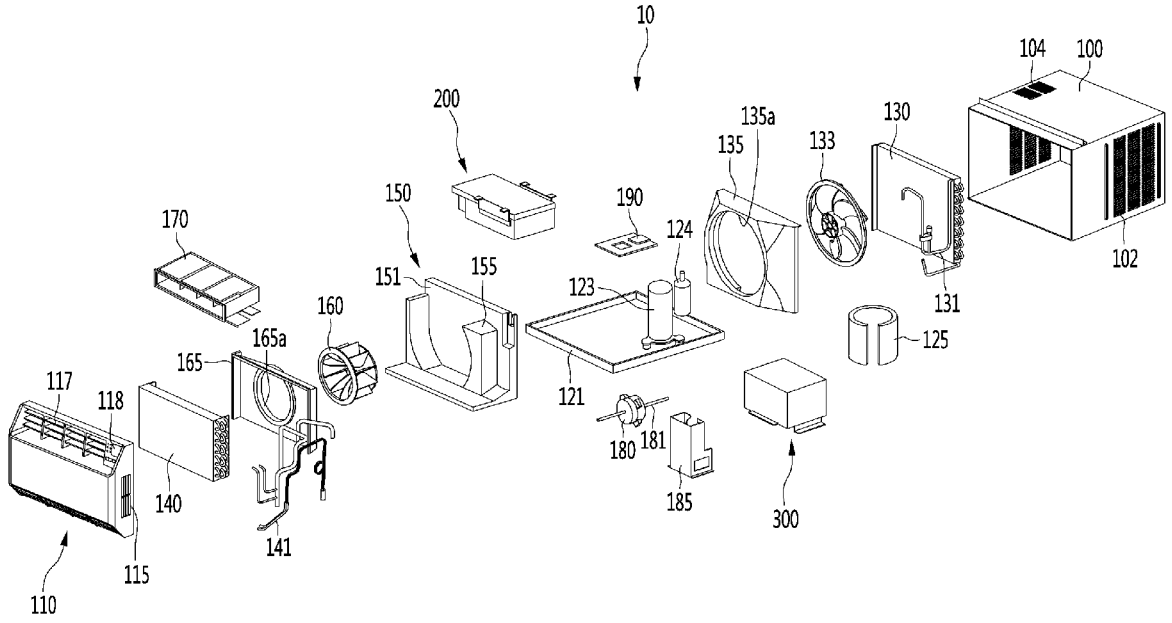
FIG. 6 is an exploded perspective view illustrating the constituents of the main body according to an embodiment of the invention.

FIG. 3 is an exploded perspective view illustrating constituents of the air conditioner according to an embodiment of the invention. FIG. 4 is a perspective view illustrating constituents of the main body of the air conditioner according to an embodiment of the invention. FIG. 5 is a side view illustrating the constituents of the main body. FIG. 6 is an exploded perspective view illustrating the constituents of the main body.

[Main Body]

Referring to FIG. 3, the air conditioner 10 may further include a main body 120 provided inside the case 100. The main body 120 may be separably coupled to the case 100. The main body 120 may be separated or removed from the case 100 as required for maintenance or repair procedures.

The main body may include a base 121, an outdoor-side body which is installed or provided on the base 121 and through which the outdoor air flows and an indoor-side body which is installed on the base 121 and through which the indoor air flows or passes. The outdoor-side body and the indoor-side body may be disposed or provided at both sides with respect to an air guide 150, respectively. For example, the outdoor air may flow through one side, and the indoor air may flow through the other side with respect to the air guide 150.

[Constituent of Outdoor-Side Body]

The outdoor-side body may include a compressor 123, a gas/liquid separator 124, a condenser 130, a condensation fan 133, a shroud 135, and a fan motor 180. The outdoor-side body may further include a control box 200 and a reactor assembly 300 as components (control components) for controlling the inverter of the air conditioner 10, for example, for controlling an inverter of the compressor 123 or blower fans 133 and 160. The control box 200 may be referred to as a "first control component", and the reactor assembly 300 may be referred to as a "second control component".

[Compressor and Gas/Liquid Separator]

The compressor 123 may include an inverter compressor that is adjustable in frequency. Thus, when a cooling load of the air conditioner 10 is low, the compressor 123 operation may decrease in frequency. Conversely, when the cooling load is high, the compressor 123 operation may increase in frequency. The compressor 123 may include a rotary compressor.

The compressor 123 may be installed or provided on a top surface of the base 121. A soundproof member 125 for reducing noise generated in the compressor 123 may be disposed or provided on an outer circumferential surface of the compressor 123. For example, the soundproof member 125 may be formed of a rubber, sponge, or fiber material.

The gas/liquid separator 124 may be disposed or provided at a side of the compressor 123. The gas/liquid separator functions to separate a gas refrigerant of a refrigerant suctioned into the compressor 123 and then guide the gas refrigerant to the compressor 123.

The compressor 123 may be disposed or provided adjacent to an inner surface of one case side part 101 of the two case side parts 101. The control box 200 and the reactor assembly 300 may be disposed or provided adjacent to an inner surface of the other case side part 101 of the two case side parts 101.

[Condenser and Condensation Fan]

The condenser 130 may be disposed or provided inside the rear portion of the case 100. A first tube assembly 131 may be connected to one side of the condenser 130. The refrigerant compressed in the compressor 123 may be introduced into the condenser 130 through the first tube assembly 131.

The condenser 130 may be disposed or provided so as to allow air passing through the condensation fan 133 to flow therethrough with respect to an outdoor-side air flow. For example, the condenser 130 may be disposed or provided at an outlet side of the condensation fan 133.

The condensation fan 133 may include an axial fan. Thus, outdoor air suctioned into the case 100 through the outdoor suction part 102 provided in each of both sides of the case 100 may be suctioned in an axial direction of the condensation fan 133 and then discharged in the axial direction of the condensation fan 133. The outdoor air may be discharged into the outdoor space through the outdoor discharge part 109 provided in the rear portion of the case 100.

[Shroud]

The shroud 135 may be coupled to the condensation fan 133 to guide a flow of the air passing through the condensation fan 133. The shroud 135 may include a shroud opening 135*a* for guiding the air to a suction side of the condensation fan 133. For example, the outdoor air suctioned into the case 100 through the outdoor suction part 102 may be suctioned into the condensation fan 133 through the shroud opening 135*a*. The shroud opening 135*a* may have a circular shape (not limited thereto) and be configured so that the condensation fan 133 is inserted therein.

[Component for Controlling Inverter: Control Box]

The control box 200 may be disposed or provided between the shroud 135 and the air guide 150. For example, the outdoor-side air passage 195 through which the outdoor air flows may be disposed or provided in a space between the shroud 135 and the air guide 150.

The control box 200 may be disposed or provided in an upper portion of the outdoor-side air passage 195. With the above-described arrangement, the outdoor air suctioned through the outdoor suction part 102 may pass through the control box 200 while the outdoor air flows, which will cool the control box 200. Detailed constituents of the control box 200 will be described below.

[Fixing Bracket]

The outdoor-side body may further include a fixing bracket 190 coupled to the control box 200. The fixing bracket 190 may extend from the shroud 135 to the air guide so that the control box 200 is disposed or provided in the space located between the shroud 135 and the air guide 150.

The control box 200 may be coupled to an upper portion of the shroud 135 and an upper portion of the air guide 150 by the fixing bracket 190. A shroud coupling part 135*b* may be disposed or provided on the shroud 135, and an air guide coupling part 150*b* may be disposed or provided on the air guide 150.

Both side portions of the fixing bracket 190 may be respectively coupled to box brackets 250 (see, e.g., FIG. 9) disposed or provided on both sides of the control box 200 and coupled to the shroud coupling part 135*b* and the air guide coupling part 150*b* by using a coupling member. For example, the fixing bracket 190 may be coupled to the control box 200, the shroud 135, and the air guide 150 at once through the coupling member. Through the above-described constituents, the control box 200 may be stably supported on the shroud 135 and the air guide 150.

[Component for Controlling Inverter: Reactor Assembly]

The reactor assembly 300, in general, is an electronic device that stores electromagnetic energy and has reactance that is highly inductive to a sudden change in current. The reactor assembly 300 may be installed on the base 121 and disposed or provided below the control box 200. The reactor assembly 300 requires cooling because it generates high-temperature heat.

In detail, the reactor assembly 300 and the control box 200 may be disposed or provided in the outdoor-side air passage 195. For example, the control box 200 and the reactor assembly 300 may be arranged to be vertically spaced apart from each other in the outdoor-side air passage 195. Through the above-described constituents, heat from an upper air of the outdoor air flowing through the outdoor-side air passage 195 may be released while passing through the control box, and heat of lower air may be released while passing through the reactor assembly 300.

Since the control box 200 and the reactor assembly 300 are disposed or provided in the outdoor-side air passage 195, and the outdoor-side air passage 195 is separated from the indoor-side air passage 191 (see, e.g., FIG. 7) by the air guide 150, heat generated in the control box 200 or the reactor assembly 300 may be prevented from being transferred to the indoor space.

[Fan Motor]

The fan motor 180, in general, is a motor for imparting rotational force to the blower fans 133 and 160. For example, the fan motor 180 may be coupled to both the condensation fan 133 and an evaporation fan 160 to rotate the condensation fan 133 and the evaporation fan 160 together with each other.

In detail, for example, a motor shaft 181 may be coupled to the fan motor 180, and the motor shaft 181 may pass through the fan motor 180 so as to extend to both sides of the fan motor 180. Also, both the sides of the motor shaft 181 may be coupled to the condensation fan 133 and the evaporation fan 160. For example, the two fans 133 and 160 may be connected to the motor shaft 181 of the fan motor 180. When the fan motor 180 is driven, the condensation fan 133 and the evaporation fan 160 may rotate together with each other. For example, the fan motor 180 may include a BLDC motor of which an inverter is controllable.

The fan motor 180 may be disposed or provided at a central portion, or an approximate central portion, with respect to a vertical direction in a space between the air guide 150 and the shroud 135. For example, the fan motor 180 may be disposed or provided in the space between the control box 200 and the reactor assembly 300 with respect to the vertical direction. According to the above-described constituents, the spatial utilization of the outdoor-side body may be improved such that the components constituting the outdoor-side body are prevented from interrupting the air flow in the outdoor-side air passage 195.

[Motor Mount]

The outdoor-side body further may include a motor mount 185 supporting the fan motor 180. The motor mount 185 may be supported on the base 121 and protrude upward from the base 121. The motor mount 185 may reduce transmission of noise or vibration generated in the fan motor 180 to the base 121.

The fan motor 180 may be spaced above the base 121 by the motor mount 185 so as to prevent (or significantly reduce) condensed water existing in the base 121 from permeating into the fan motor 180.

[Constituent of Indoor-Side Body]

The indoor-side body may include an evaporator 140, an orifice 165, the evaporation fan 160, a discharge guide 170, the fan motor 180, and the motor mount 185.

[Evaporator and Evaporation Fan]

The evaporator 140 is disposed or provided on an inner surface of the front panel 110. Indoor air suctioned through the plurality of indoor suction parts 115 and 116 may pass through the evaporator 140. The evaporator 140 may be connected to a second tube assembly 141 that guides a flow of the refrigerant introduced into the evaporator 140. The second tube assembly 141 may include an expansion device for decompressing the refrigerant that is condensed in the condenser 130. For example, the expansion device may include at least one of an expansion valve and a capillary tube.

The evaporation fan 160 may be disposed or provided so that air passing through the evaporator 140 passes therethrough with respect to the indoor-side air flow. For example, the evaporation fan 160 may be disposed or provided at an outlet side of the evaporator 140.

The evaporation fan 160 may include a centrifugal fan. The indoor air suctioned into the case through the plurality of indoor suction parts 115 and 116 provided in both the sides and the lower portion of the front panel 110 may flow backward (rearward) via a front surface of the evaporator 140 and then be suctioned in an axial direction of the evaporation fan 160. Also, the indoor air may be discharged in a radial direction of the evaporation fan 160.

[Orifice]

The orifice 165 may be coupled to the evaporation fan 160 to guide a flow of the air passing through the evaporation fan 160. The orifice 165 may include an orifice opening 165*a* guiding the air to a suction side of the evaporation fan 160. For example, the indoor air cooled in the evaporator 140 may be suctioned into the evaporation fan 160 through the orifice opening 165*a*. For example, the orifice opening 165*a* may have a circular shape (not limited thereto) and be disposed or provided at a position corresponding to a front end of the evaporation fan 160.

[Discharge Guide]

The discharge guide 170, in general, is a component that guides the air passing through the evaporation fan 160 toward the front panel 110, i.e., a front side. For example, the discharge guide 170 may have a hollow panel or pipe shape (not limited thereto). Also, a discharge passage through which the air passing through the evaporation fan 160 passes may be provided in the discharge guide 170.

An outlet part 171 through which the air is discharged to the discharge part 117 of the front panel 110 is provided in a front portion of the discharge guide 170. The discharge part 117 and the outlet part 171 may be aligned with each other in a front and rear direction.

An outlet guide 173 for guiding the flow direction of the air may be provided in the discharge guide 170. The outlet guide 173 may have a plate shape (not limited thereto) and may be disposed or provided to extend forward and backward on an inner surface of the discharge guide 170. According to the above-described constituents, the air flowing through the discharge guide 170 may stably flow forward toward the discharge part 117.

The discharge guide 170 may be coupled to a front surface of the air guide to extend forward. The air passing through the evaporation fan 160 may be guided to the discharge guide 170 through a closed space formed by the discharge guide 170 and the air guide 150.

The discharge guide 170 may be supported above the evaporator 140 and the orifice 165. Also, the rear portion of the discharge guide 170 may be supported on a top surface of a guide support part 166 provided on the air guide 150. The guide support part 155, in general, is a portion protruding forward from the guide body 151 of the air guide 150.

[Air Guide]

The air guide 150 serves as a partition plate that partitions or separates the outdoor-side body from the indoor-side body and separates the indoor-side air passage 191 from the outdoor-side air passage 195.

A front surface of the air guide 150 may guide the indoor air passing through the evaporation fan 160 so that the indoor air is introduced into the discharge guide 170. A rear surface of the air guide 150 may guide the outdoor air suctioned through the outdoor suction part 102 so that the outdoor air is suctioned into the condensation fan 133.

The air guide 150 may include a guide body 151 that separates the indoor-side air passage 191 from the outdoor-side air passage 195. The guide body 151 may be supported on the base 121 and extend upwardly relative to the base 121. The guide body 151 may have an upper end thereof that is coupled to or in contact with the case top part 103.

A shaft penetration part 151*a* (see, e.g., FIG. 13) through which the motor shaft 181 passes may be provided in the guide body 151. The shaft penetration part 151*a* may be disposed or provided at a central portion or an approximately central portion of the guide body 151.

The air guide 150 may further include a guide support part 155 that protrudes or extends forward (outward) from the guide body 151. The discharge guide 170 may be supported on a top surface of the guide support part 155.

Figure 7:
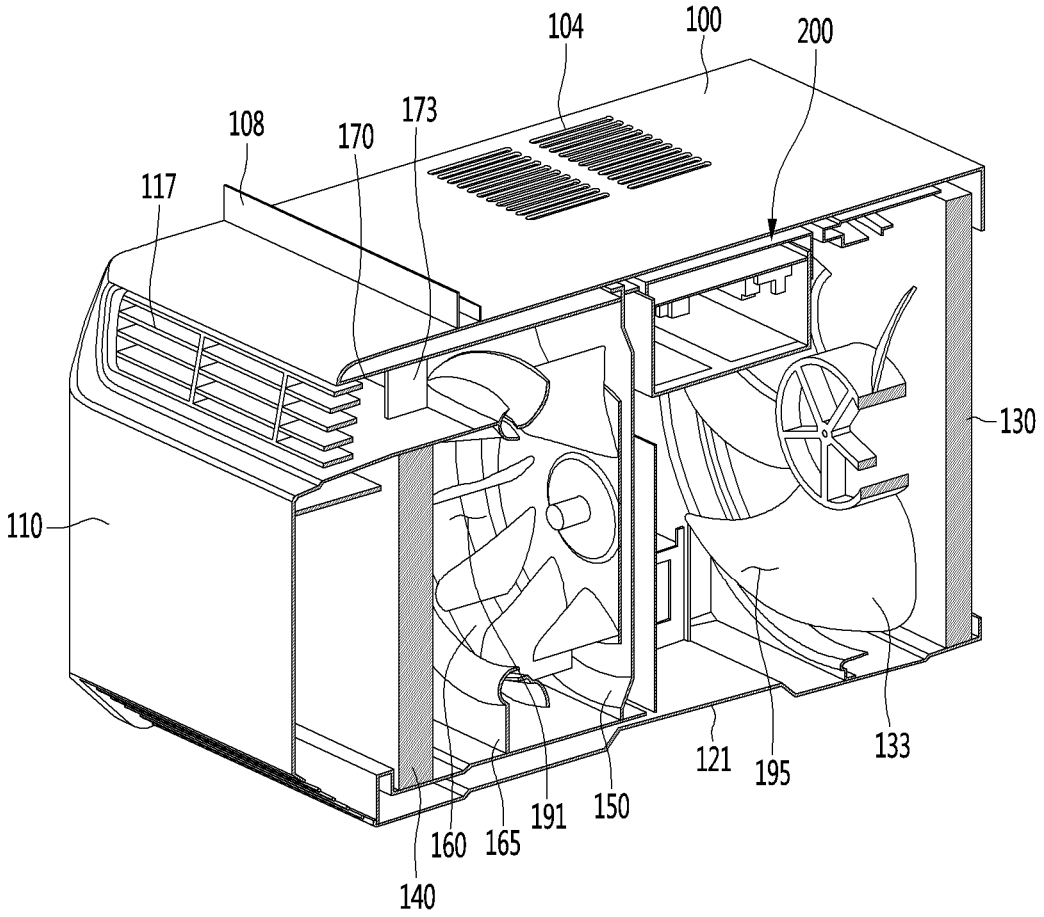
FIG. 7 is a cross-sectional view taken along line VII-VII' of FIG. 2.
Figure 8:
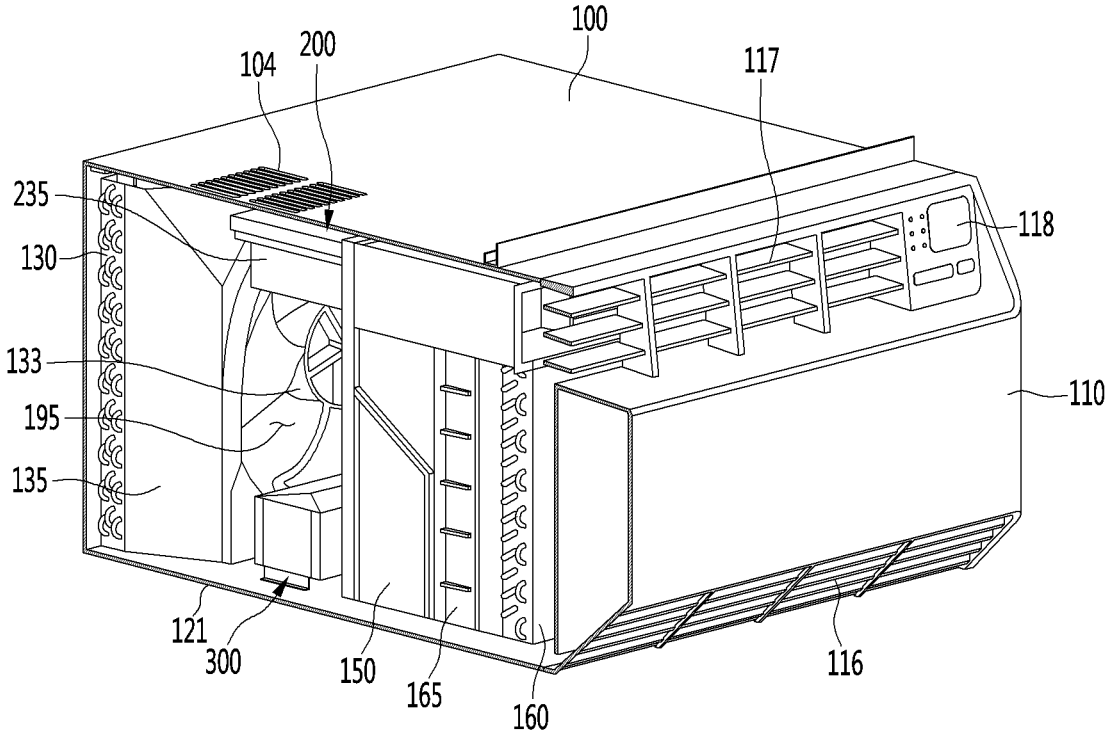
FIG. 8 is a cross-sectional view taken along line VIII-VIII' of FIG. 2.

FIG. 7 is a cross-sectional view taken along line VII-VII' of FIG. 2. FIG. 8 is a cross-sectional view taken along line VIII-VIII' of FIG. 2.

Referring to FIGS. 7 and 8, the case 100 may accommodate therein both the indoor-side air passage 191 through which the indoor air flows and the outdoor-side air passage 195 through which the outdoor air flows. The indoor-side air passage 191 and the outdoor-side air passage 195 may be arranged to be partitioned into front and rear sides by the air guide 150.

Here, the "front side" may represent a side at which the front panel 110 is disposed from the air guide 150. The "rear side" may represent a side opposite to the front side, i.e., a side from which the outdoor air is discharged (a side at which the outdoor discharge part is disposed) from the air guide 150.

[Indoor-Side Air Passage]

The indoor-side air passage 191 may accommodate the evaporator 140 for cooling air, the evaporation fan 160 generating a cooled air flow, and the discharge guide 170 guiding the air passing through the evaporation fan 160 to the discharge part 117 of the front panel 110.

For example, the indoor-side air passage may include a first indoor-side passage through which the air suctioned through the plurality of indoor suction parts 115 and 116 flows to an inflow side of the evaporator 140 (a front side of the evaporator 140), a second indoor-side passage through the air is suctioned from the discharge side of the evaporator 140 in an axial direction of the evaporation fan 160, and a third indoor-side passage through which the air discharged in the radial direction of the evaporation fan 160 is introduced into the discharge guide 170 to flow to the discharge part 117 of the front panel 110.

[Outdoor-Side Air Passage]

The outdoor-side air passage 195 may accommodate the condensation fan 133 for generating the suction of the outdoor air through the outdoor suction part 102, the fan motor 180 for providing driving force to the condensation fan 133 and the evaporation fan 160, the condenser 130 for condensing the outdoor air passing through the fan motor 180, and the control box 200 and the reactor assembly 300, which are provided as control components for controlling an operation of the air conditioner 10. The compressor 123 and the gas/liquid separator 124 may also be disposed or provided in the outdoor-side air passage 195.

The outdoor-side air passage 195 may include a first outdoor-side passage through which the outdoor air suctioned through the outdoor suction part 102 of both the outdoor suction parts 102 cools the control box 200 and the reactor assembly 300 while passing through the control box 200 and the reactor assembly 300 and then is suctioned in the axial direction of the condensation fan 133 and a second outdoor-side passage through the outdoor air is discharged in the axial direction of the condensation fan 133 to pass through the condenser 130.

The control box 200 and the reactor assembly 300 may be disposed or provided on the inner surface of the case side part 101 to allow the outdoor air having a relatively low temperature and passing through the outdoor suction part 102 to flow therethrough, thereby improving a cooling effect of the control box 200 and the reactor assembly 300. For example, the control box 200 and the reactor assembly 300 may be disposed or provided at the upstream side of the condenser 133 with respect to the flow of the outdoor air.

The control box 200 may be disposed or provided in the upper portion of the outdoor-side air passage 195, and the reactor assembly 300 may be disposed or provided in a lower portion of the outdoor-side air passage 195. As described above, the control box 200 and the reactor assembly 300 may be spaced apart from each other, and thus, the cooling passages for cooling the control box 200 and the reactor assembly 300 may not be affected from each other. Thus, the cooling effect of the control components may be more improved, and resistance in the outdoor-side air flow may be relatively low as compared with a conventional apparatus or different arrangement.

Another embodiment will now be described. Although the control box 200 is disposed or provided in the upper portion of the outdoor-side air passage 195, and the reactor assembly 300 is disposed or provided in the lower portion of the outdoor-side air passage 195 in this embodiment, it is understood that the present disclosure is not limited thereto. For example, the control box 200 may be disposed or provided in the lower portion of the outdoor-side air passage 195, and the reactor assembly 300 may be disposed or provided in the upper portion of the outdoor-side air passage 195.

A heat dissipation plate 235 provided in the control box 200 may be disposed closer to the case side part 101 than elements 233 that are heat generation components of the control box 200 so as to more easily and more efficiently perform cooling of the heat dissipation plate 235.

The outdoor air suctioned through the other outdoor suction part 102 of both the outdoor suction parts 102 may pass through the compressor 123 that is disposed or provided adjacent to the other outdoor suction part 102 and installed in the outdoor-side air passage 195.

Figure 9:
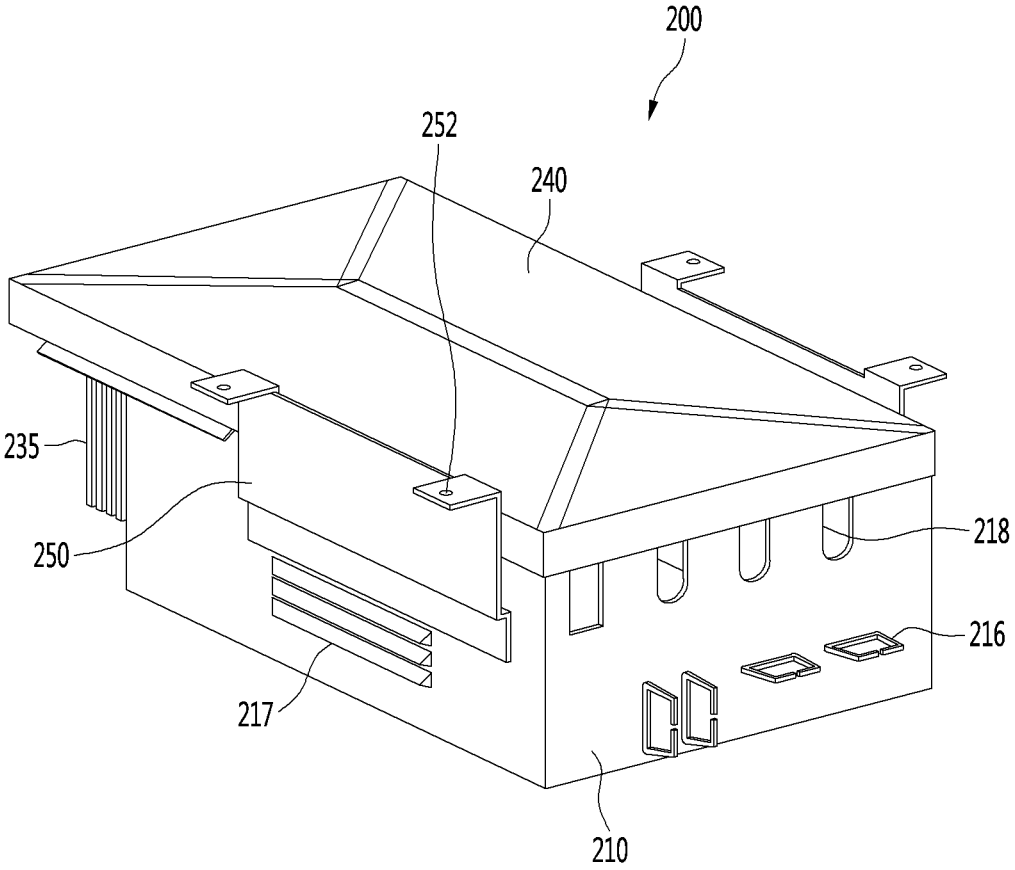
FIG. 9 is a perspective view illustrating constituents of a control box according to an embodiment of the invention.
Figure 10:
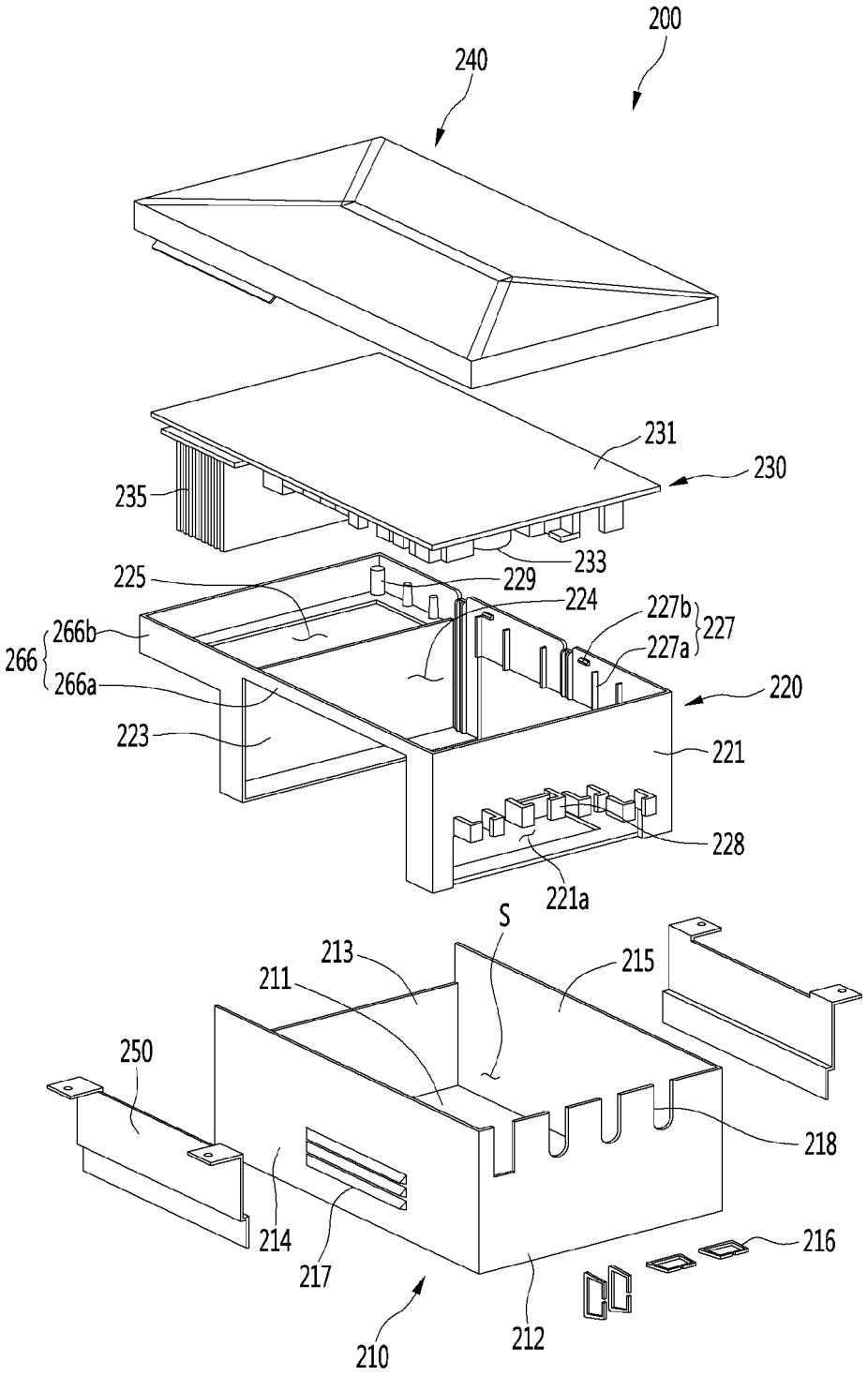
FIG. 10 is an exploded perspective view illustrating the constituents of the control box according to an embodiment of the invention.
Figure 11:
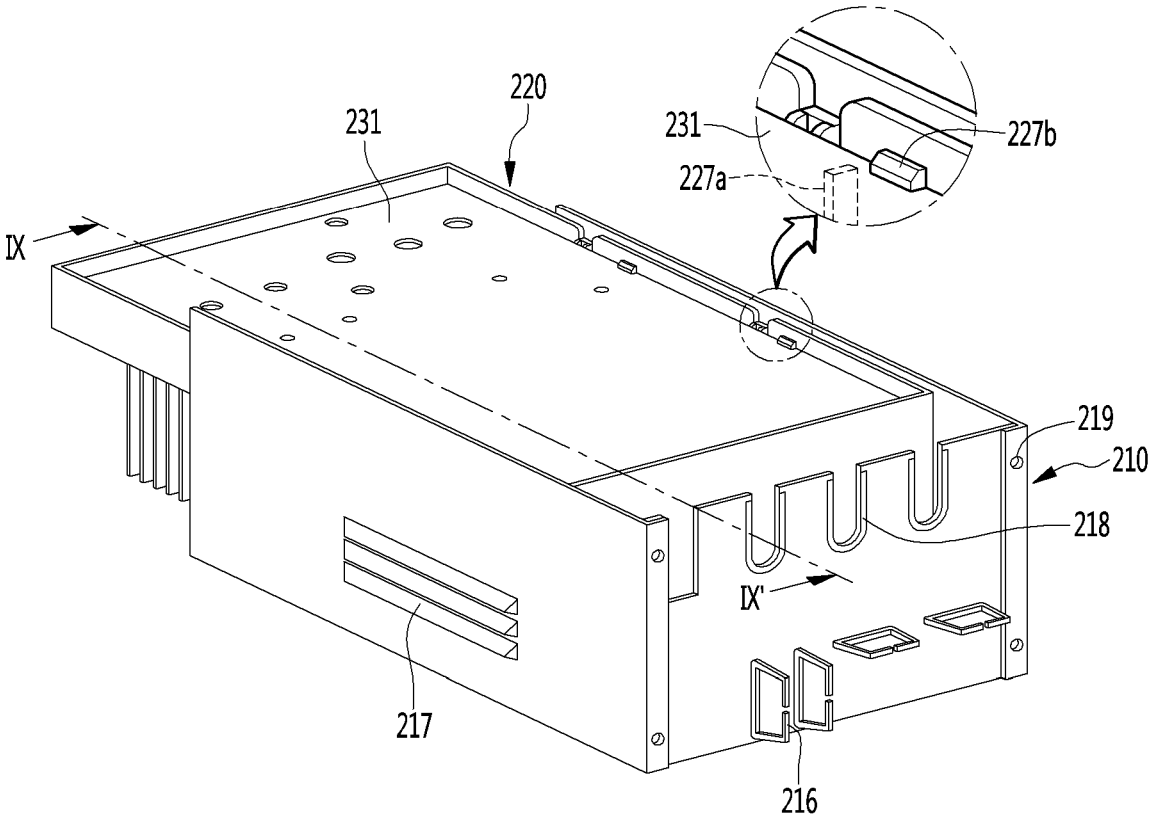
FIG. 11 is a perspective view illustrating a state in which a box cover and a box bracket are removed from the control box according to an embodiment of the invention.
Figure 12:
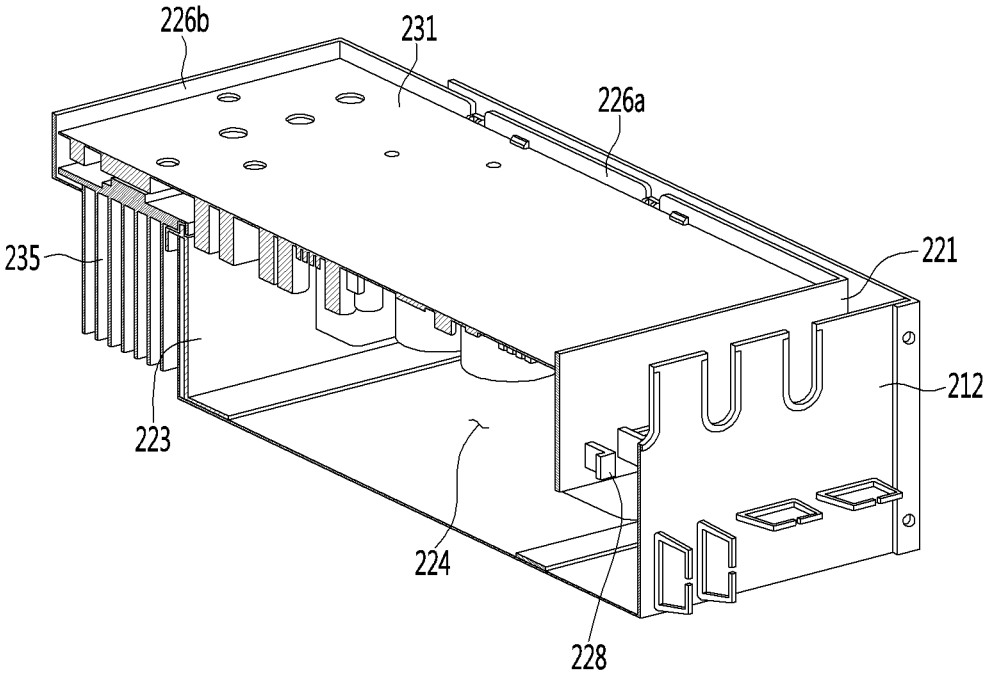
FIG. 12 is a cross-sectional view taken along line IX-IX' of FIG. 11.
Figure 13:
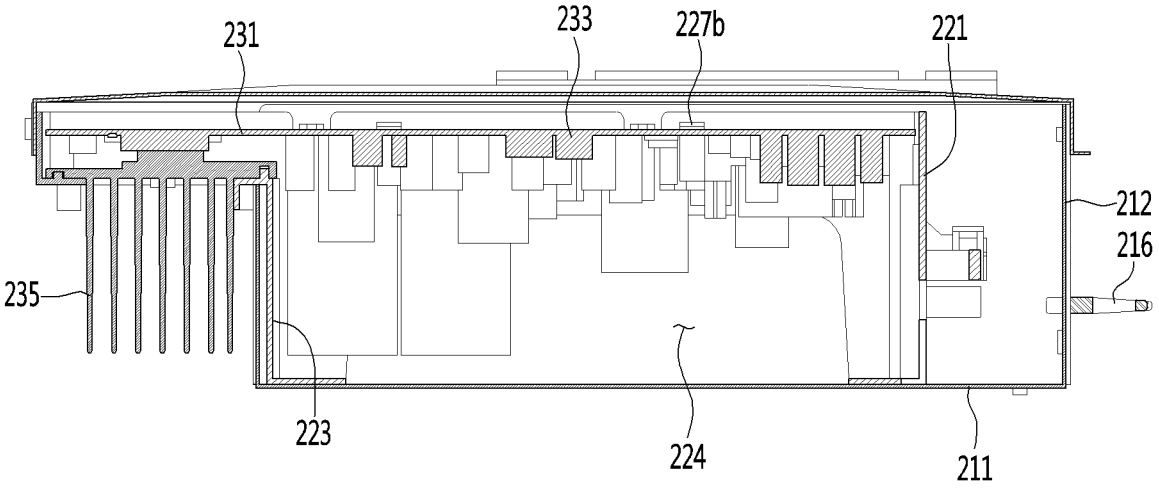
FIG. 13 is a cross-sectional view taken along line IX-IX' of FIG. 11.

FIG. 9 is a perspective view illustrating constituents of the control box according to an embodiment of the invention, FIG. 10 is an exploded perspective view illustrating the constituents of the control box, FIG. 11 is a perspective view illustrating a state in which a box cover and a box bracket are removed from the control box, and FIGS. 12 and 13 are cross-sectional views taken along line IX-IX' of FIG. 11.

<Control Box>

Referring to FIGS. 9 through 13, the control box 200 may include a box case 210, a PCB support part 220 coupled to the box case 210, a PCB assembly 230 supported by the PCB support part 220, and a box cover 240 covering an upper portion of the PCB assembly 230.

[PCB Assembly]

The PCB assembly 230 may include a rectangular or substantially rectangular shaped PCB 231 (shape not limited thereto) and an element 233 provided on the PCB 231. The element 233 may be disposed or provided on a bottom surface of the PCB 231. The element 233 may include heat generation components for controlling the inverter of the air conditioner 10. For example, the heat generation components may further include a micron computer, an inverter, a converter, an EEPROM, a rectifier diode, or a condenser.

The PCB assembly 230 may further include a heat dissipation plate 235 for releasing heat generated in the PCB assembly 230 or the element 233. For example, the heat dissipation plate 235 may be disposed or provided on the bottom surface of the PCB 231. The element 233 and the heat dissipation plate 235 may protrude downward from the PCB 231.

The heat dissipation plate 235 may include a plurality of fins that are spaced apart from each other, e.g., spaced apart in a left and right direction. Each of the plurality of fins may have a rectangular thin plate shape (shape is not limited thereto).

The outdoor air suctioned through the outdoor suction part 102 may pass or flow first through the heat dissipation plate 235 of the PCB assembly 230 and cool the heat dissipation plate 235. For example, when the PCB assembly 230 is seated on the box case 210 and coupled to the PCB support part 220, the heat dissipation plate 235 is disposed or provided adjacent to the inner surface of the case side part 101.

[PCB Support Part]

The control box 200 may further include the PCB support part 220 disposed or provided below the PCB 231 to support the PCB 231. The PCB support part 220 may be made of a plastic or resin material and integrally manufactured through injection molding. However, it is understood that the present disclosure is not limited thereto. For example, the PCB support part 220 may be made of a metal material.

The PCB 231 may be coupled to the PCB support part 220 so that the element 233 and the heat dissipation plate 235 disposed or provided on the PCB 231 face a lower side thereof. That is, the element 233 and the heat dissipation plate 235 are not disposed or provided on the top surface, but are placed upside down on the bottom surface with respect to the PCB 231. Thus, while the condensation fan 133 operates, accumulation of dusts, which are contained in the outdoor air suctioned through the outdoor suction part 102, on the PCB 231 may be reduced or minimized.

The PCB support part 220 may include an upper part 226 having an opened top surface. For example, the upper part 226 may have a rectangular shape (not limited thereto) with an empty inner side. The upper part 226 may have a size corresponding to that of the PCB 231 so that the PCB 231 is disposed or provided inside the upper part 226. That is, the PCB 231 may be coupled to the inside of the upper part 226.

In detail, the upper part 226 includes a first upper part **226*a* surrounding the element 233 and a second upper part 226*b* surrounding the heat dissipation plate 235. The first upper part 226*a* and the second upper part 226*b* may be connected to each other. Each of the first and second upper parts 226*a* and 226*b* may be smooth or flat without having a stepped portion. The first and second upper parts 226*a* and 226*b* may be partitioned by a support partition part 223** that will be described later.

[PCB Support Part: PCB Coupling Part]

The PCB support part 220 may include a PCB coupling part 229 to which the PCB 231 is coupled through a coupling member. For example, the PCB support part 220 may be screw-coupled to the PCB coupling part 229. The PCB coupling part 229 is disposed or provided on at least one of the first and second upper parts **226*a* and 226*b* of the PCB support part 220**.

The PCB coupling part 229 may be disposed or provided on an inner surface of the upper part 226 of the PCB support part 220. For example, there may be more than one PCB coupling part 229. In such case, the plurality of PCB coupling parts 229 may be spaced apart from each other on the inner surface of the upper part 226, which corresponds to each of vertexes of the upper part 226 of the PCB support part 220. Through the above-described constituents, the PCB 231 may be relatively stably supported by the PCB support part 220.

[PCB Support Part: Support Rib]

The PCB support part 220 may further include a support rib 227 for supporting an edge of the PCB 231. More than one support rib 227 provided to support the PCB 231 and guide positioning of the PCB 231.

In detail, the support rib 227 may include a vertical rib 227*a* that is disposed or provided in a vertical direction and a horizontal rib 227*b* that is lengthily disposed or provided in a horizontal direction. The vertical and horizontal ribs 227*a* and 227*b* may be provided in plurality and disposed on the inner surface of the first or second upper parts 226*a* or 226*b* of the PCB support part 220.

The vertical rib 227*a* may be disposed or provided on the inner surface of the upper part 226 corresponding to a bottom surface of the PCB 231. The vertical rib 227*a* may protrude or extend by a predetermined length inward from the inner surface of the upper part 226 in order to support the bottom surface of the PCB 231. The vertical rib 227*a* may extend up to a height of an upper end of the PCB coupling part to support the PCB 231.

The horizontal rib 227*b* may be disposed or provided on the inner surface of the upper part 226 corresponding to a top surface of the PCB 231. The horizontal rib 227*b* may protrude or extend by a predetermined length inward from the inner surface of the upper part 226 in order to support the top surface of the PCB 231. The horizontal rib 227*b* may be made of an elastically deformable material in order to guide the PCB 231 so that the PCB 231 is relatively easily seated on the upper part 226 of the PCB support part 220.

The vertical rib 227*a* and the PCB coupling part 229 together may support the PCB 231, and the horizontal rib 227*b* may prevent the PCB 231 from being separated from the upper part 226 when shaking or movement due to vibration occurs. Through the above-described constituents, the PCB assembly 230 may be relatively easily coupled to the PCB support part 220. Also, when the shaking or movement due to the vibration of the compressor 123 or the fan motor 180 occurs, the separation of the PCB assembly 230 from the PCB support part 220 may be prevented.

[PCB Support Part: Side Part and Support Partition Part]

The PCB support part 220 may further include a side part 221 and a support partition part 223, which extend downward from the upper part 226.

In detail, the side part 221 and the support partition part 223 are disposed or provided to be spaced apart from each other. For example, the side part 221 and the support partition part 223 may be symmetrical to each other or disposed or provided to face each other. Also, a first accommodation part 224 in which the element 233 is accommodated may be provided between the side part 221 and the support partition part 223. That is, the first accommodation part 224 in which the element 233 is accommodated may be provided in a space that is surrounded by the side part 221, the support partition part 223, and the first upper part 226*a*.

The PCB support part 220 may further include a second accommodation part 225 in which the heat dissipation plate 235 is accommodated. The second accommodation part 225 may represent a space defined or formed by the support partition part 223 and the second upper part 226*b*. That is, the first and second accommodation parts 224 and 225 may be partitioned by the support partition part 223, and the first and second upper parts 226*a* and 226*b* may be partitioned by the support partition part 223. Through the above-described constituents, the spatial utilization for the installation of the element 233 and the heat dissipation plate 235 may be improved relative to a conventional or different arrangement.

Also, the support partition part 223 may be disposed or provided between the element 233 and the heat dissipation plate 235 to function as a blocking plate and prevent the outdoor air suctioned through the outdoor suction part 102 from directly acting on the element 233. Thus, the malfunction of the PCB assembly 230, which may occur when the outdoor air having a high flow rate directly acts on the element 233, may be prevented.

The PCB support part 220 may have a cutoff part in at least one surface of front and rear surfaces thereof. For example, the cutoff part that is cut upward from the lower portion may be provided in the front surface of the PCB support part 220, and the cutoff part that is cut upward from the lower portion may be provided in the rear surface of the PCB support part 220.

As described above, the PCB support part 220 may include the first accommodation part 224 in which the element 233 is accommodated. Also, it is necessary that the outdoor air is introduced into the first accommodation part 224 to cool the element 233 disposed or provided in the first accommodation part 224. For this, the cutoff part may be provided in at least one surface of the front and rear surfaces of the PCB support part 220, and the outdoor air suctioned through the outdoor suction part 102 may be introduced into the first accommodation part 224 through the case heat releasing hole 217 defined in the box case 210. Through the above-described constituents, the cooling of the element 233 may be more easily performed relative to a conventional or different arrangement.

[PCB Support Part: Wire Guide and Lead-Out Opening]

The PCB support 220 may further include at least one wire guide to guide a position of a wire connected to the PCB assembly 230. The wire guide 228 may include a rib protruding from the side part 221, and the rib holds the wire to keep the wire in place and prevent it from moving.

The side part 221 may further include a lead-out opening 221*a* through which the wire connected to the PCB assembly 230 is led out to the outside of the PCB support part 220. The lead-out opening 221*a* may be provided by cutting the side part 221 upward from the lower portion. The wire guide 228 may be disposed or provided on an upper end of the lead-out opening 221*a*. Thus, the wire connected to the PCB assembly 230 may pass through the lead-out opening 221*a* and then be restricted by the wire guide 228 so that a lead-out direction of the wire is directed upwardly.

[Box Case]

The control box 200 may further include the box case 210 which provides the installation space of the element 233. The box case 210 may have a hexahedral shape (not with a top surface opened. However, the present disclosure is not limited thereto. For example, the box case 210 may have a polyhedral shape.

The box case 210 may be formed of a metal material to firmly support the PCB support part 220. In detail, the box case 210 may include a box bottom part 211 defining or forming a bottom surface of the box case 210, box side parts 212 and 213 respectively extending upward from both ends (e.g., right and left sides) of the box bottom part 221, and box front and rear parts 214 and 215 that connect the box side parts 212 and 213 to the box bottom part 221. That is, the box case 210 provides an inner space S defined or formed by the box bottom part 211, the box side parts 212 and 213, the box front part 214, and the box rear part 215.

The PCB support part 220 coupled to the PCB assembly 230 may be seated in the inner space S. Here, the side part 221, the support partition part 223, and the first upper part 226*a* of the PCB support part 220 may be disposed or provided in the inner space S.

However, the second upper part 226*b* may be disposed or provided outside the inner space S. For this arrangement, one box side part 213 of the two box side parts 212 and 213 may have a height that is less than that of the other box side part 212.

Through the above-described constituents, the heat dissipation plate 235 may be disposed or provided outside the inner space S. Thus, the heat dissipation plate 235 may be effectively cooled by the outdoor air suctioned through the outdoor suction part 102.

[Box Case: Case Heat Releasing Hole]

The box case 210 may have a case heat releasing hole 217 formed therein through which the heat generated in the PCB assembly 230 is released or dissipated to the outside. The case heat releasing hole 217 may include a through-hole defined or formed by penetrating or cutting a portion of at least one of the box front part 214, the box rear part 215, and the box side parts 212 and 213, which define an outer appearance of the box case 210.

In this embodiment, the case heat releasing hole 217 is provided in the box front part 214. That is, the case heat releasing hole 217 may be provided to face the cutoff part provided in the front surface of the PCB support part 220. Through the above-described constituents, the external air passing through the case heat releasing hole 217 may continuously pass through the cutoff part of the PCB support part 220 to cool the element 233. That is, since flow resistance of air for cooling the element 233 is minimized, the cooling effect of the element 233 may be improved.

[Box Case: Wire Penetration Part]

The box case 210 may further include a wire penetration part 218 through which the wire connected to the PCB assembly 230 is led out to the outside of the box case 210. The wire penetration part 218 may be provided by recessing an upper portion of the box side part 212 downward. There may be more than one wire penetration part 218. In such case, the plurality of wire penetration parts 218 may be disposed or provided to be spaced apart from each other. The box cover 240 may be coupled to an upper portion of the wire penetration part 218. The wire may pass through a space defined by the wire penetration part 218 and the box cover 240.

[Box Case: Coupling Hole and Clamp]

The box case 210 may further include a coupling hole 219 for coupling the box cover 240 to the box case 210 through a coupling member. The coupling hole 219 may be defined or formed in the upper portion of the box case 210, for example, the upper portion of the box side part 212.

A clamp 216 may be provided on the box case 210. The clamp 216 may be configured to fix the wire that is led out to the outside of the box case 210 through the wire penetration part 218. The wire may be more easily arranged by the clamp 216, and a phenomenon in which the wire comes into contact with the surface of the control box having a relatively high temperature may be prevented.

[Box Cover]

The control box 200 may further include a box cover 240 coupled to the upper portion of the box case 210. The box cover 240 has a size corresponding to that of the upper part 226 of the PCB support part 220. For example, the box cover 240 may be made of a metal material (not limited thereto). The box cover 240 may be coupled to the box case 210 so as to surround the entire upper part 226 of the PCB support part 220. That is, the box cover 240 may cover the entire opened top surface of the PCB support part 220. Through the above-described constituents, the condensed water dropping from an upper side of the control box 200 may be prevented from being permeated into the inner space S of the box case 210.

The top surface of the box cover 240 may have a gradient for draining so that the condensed water dropping onto the top surface of the box cover 240 is more easily drained. That is, the top surface of the box cover 240 may prevent the condensed water dropping onto the top surface of the box cover 240 from being collected and also may have a stepped portion to allow the condensed water to be drained in a predetermined direction. Through the above-described constituents, the condensed water scattered by the rotation of the condensation fan 133 may be prevented from being permeated into the control box 200, and also, the condensed water may not be collected into the box cover 240, but be more easily drained.

[Box Bracket]

The box bracket 250 may be coupled to the control box 200. The box bracket 250 may be disposed or provided at each of both sides of the control box 200 so that the fixing bracket is coupled thereto. A coupling hole 252 coupled to the fixing bracket 190 may be defined or formed in the box bracket 250. For example, a screw may be inserted into the coupling hole 252 and then coupled to the fixing bracket 190.

The screw may be coupled to the shroud coupling part 135*b* or the air guide coupling part 150*b* to fix the fixing bracket 190, the shroud 135, and the air guide 150.

[Reactor Assembly]

Figure 14:
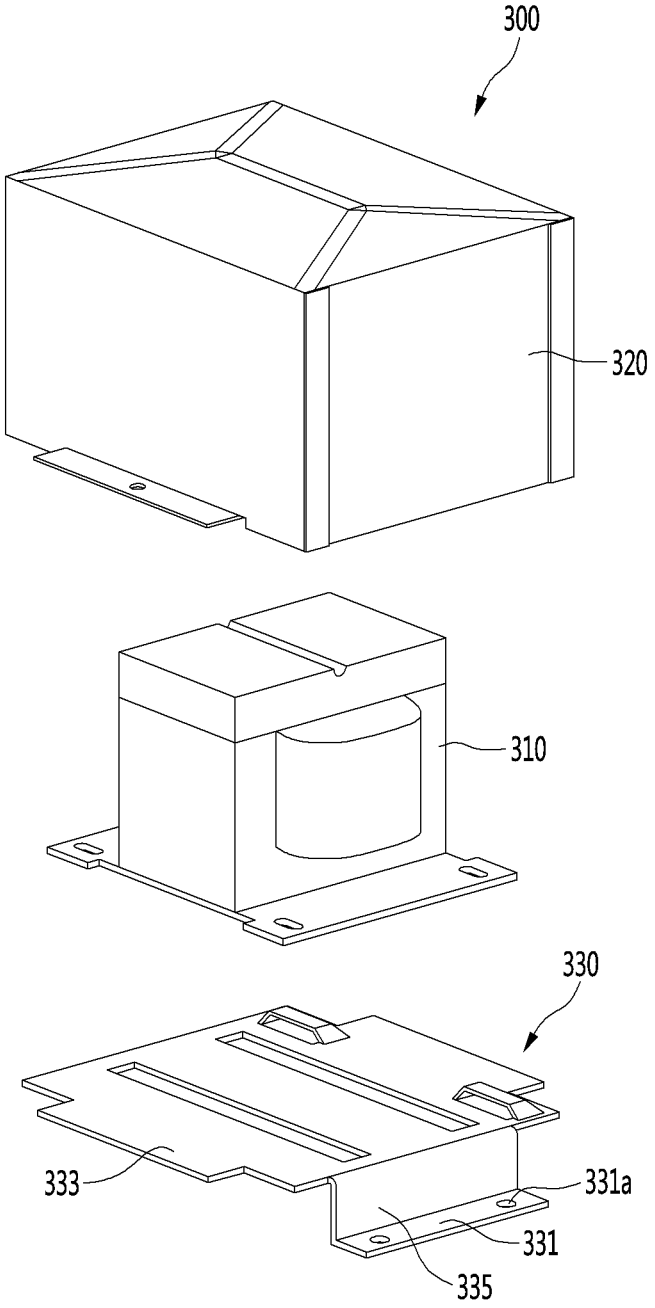
FIG. 14 is an exploded perspective view illustrating constituents of a reactor assembly according to an embodiment of the invention.

FIG. 14 is an exploded perspective view illustrating constituents of the reactor assembly according to an embodiment.

Referring to FIG. 14, an air conditioner 10 may include the reactor assembly 300. The reactor assembly 300 may be installed on the base 121 and disposed or provided in the lower portion of the outdoor-side air passage 195, i.e., below the control box 200.

The reactor assembly 300 may include a reactor bracket 330 supported on the base 121, a reactor 310 supported on the reactor bracket 330, and a reactor cover 320 coupled to the reactor bracket 330 to accommodate the reactor 310 therein (referred to herein as a "protection member").

The reactor bracket 330 may include a base coupling part having a base coupling hole 331*a* coupled to the base 121, an extension part 335 extending upward from the base coupling part 331, and a reactor seating part 333 which extends from the extension part 335 in a horizontal direction and on which the reactor 310 is seated. A coupling member may be coupled to the base coupling hole 331*a*.

Due to the structure of the reactor bracket 330, the reactor 310 may be disposed or provided at a position that is spaced above the base 121. Thus, the malfunction of the reactor 310 may be prevented in the event that the condensed water stored in the base 121 acts on the reactor 310.

Figure 15:
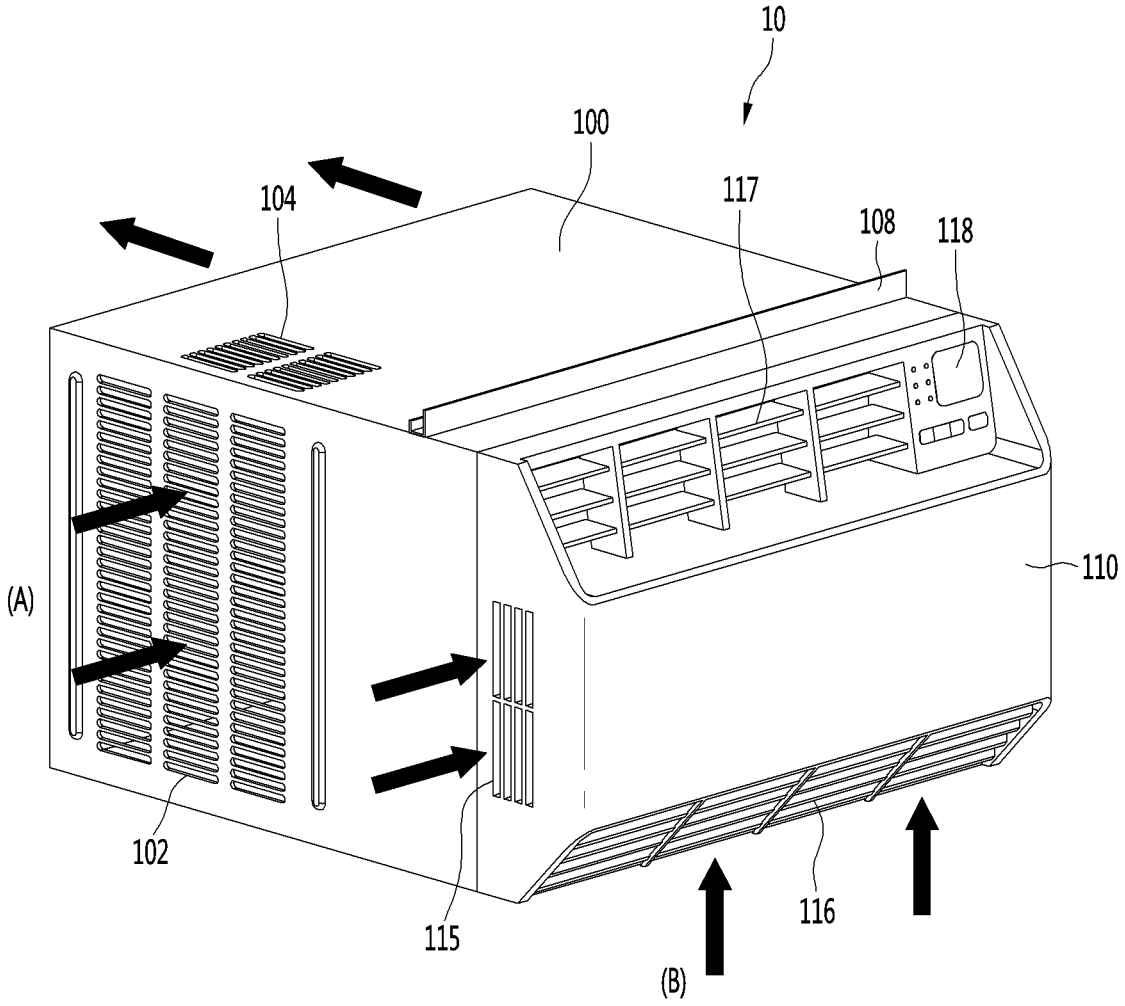
FIG. 15 is a perspective view illustrating an outdoor-side air flow A and an indoor-side air flow B according to an embodiment of the invention.
Figure 16:
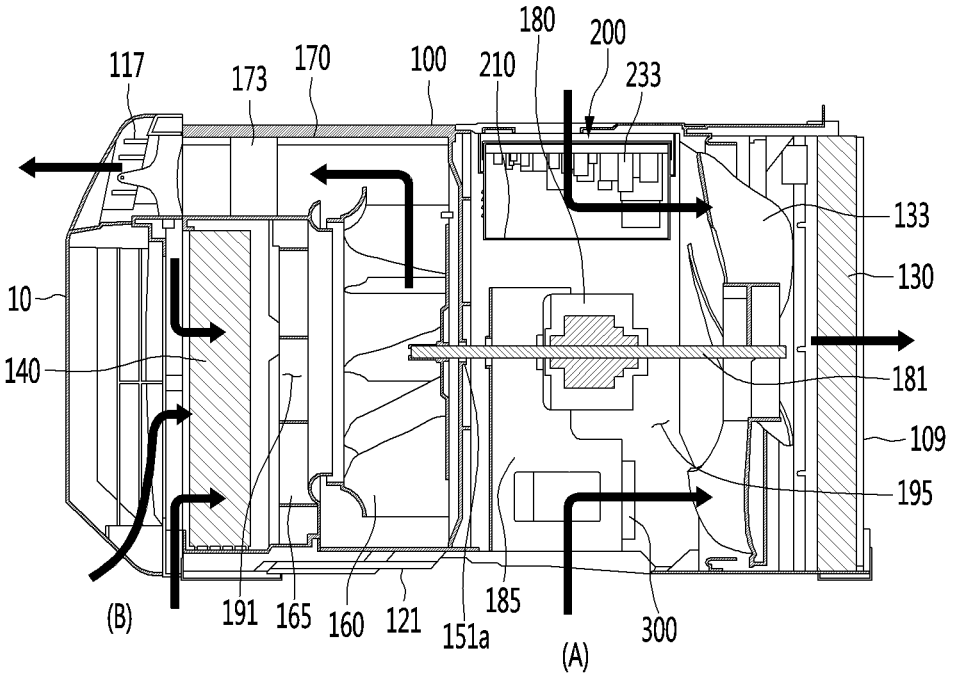
FIG. 16 is a perspective view illustrating an outdoor-side air flow A and an indoor-side air flow B according to an embodiment of the invention.

FIGS. 15 and 16 are perspective views illustrating an outdoor-side air flow A and an indoor-side air flow B according to an embodiment of the invention. Referring to FIGS. 15 and 16, when the air conditioner 10 according to an embodiment operates, the outdoor-side air flow A and the indoor-side air flow B occur. The outdoor-side air flow A and the indoor-side air flow B are described more fully below.

[Outdoor-Side Air Flow A]

The outdoor-side air flow A may occur by the operation of the condensation fan 133. For example, when the condensation fan 133 is driven, the outdoor air may be suctioned toward an inner center of the case 100 through the outdoor suction part 102 provided in each of the two case side parts 101.

The outdoor air suctioned into the case 100 through one outdoor suction part 102 may cool the control box 200 and the reactor assembly 300 while passing through the control box 200 and the reactor assembly 300, which are disposed or provided adjacent to the case side part 101.

Here, since the control box 200 and the reactor assembly 300 are disposed or provided in the upper and lower portions of the outdoor-side air passage 195, respectively, a portion of the suctioned outdoor air may cool the control box 200, and the other portion of the suctioned outdoor air may cool the reactor assembly 300. Thus, the outdoor air may cool the control box 200 and the reactor assembly 300 to improve the cooling efficiency relative to a conventional or different arrangement.

A first outdoor-side passage, through which the outdoor air passing through each of the control box 200 and the reactor assembly 300 changes in direction to flow to the suction side in the axial direction of the condensation fan 133, is provided.

A second outdoor-side passage, through which the outdoor air passing through the condensation fan 133 flows to the discharge side in the axial direction of the condensation fan 133 and then is discharged to the rear side of the case 100 through the outdoor discharge part 109, is provided.

[Indoor-Side Air Flow B]

The indoor-side air flow B may occur by the operation of the evaporation fan 160. For example, when the evaporation fan 160 is driven, the indoor air may be suctioned into the inner center of the case 100 through the plurality of indoor suction parts 115 and 116.

A first indoor-side passage, through which the suctioned indoor air flows to the inflow side of the evaporator 140, and a second indoor-side passage, through which the indoor air is suctioned from the outlet side of the evaporator 140 in the axial direction of the evaporation fan 160, may be provided.

A third indoor-side passage, through which the indoor air passing through the evaporation fan 160 is discharged in the radial direction of the evaporation fan 160 and then is introduced into the discharge guide 170 disposed or provided above the evaporation fan 160, may be provided. The indoor air flowing through the inside of the discharge guide 170 may flow toward the front panel 110 (e.g., flow in a forward direction) and then be discharged into the indoor space through the discharge part 117 of the front panel 110.

According to the above-described constituents, the control box may be more easily cooled, and the effects of the elements of the PCB assembly by the suctioned outdoor air may be reduced relative to a conventional or different arrangement. Also, the accumulation of dust on the PCB assembly may be minimized relative to a conventional or different arrangement.

Also, the PCB support part may be stably supported inside the box case, and the spatial utilization for installing the control components for the inverter control may be improved relative to a conventional or different arrangement.

Also, when the shaking or movement due to vibration of the compressor or the fan motor occurs, the PCB assembly may be stably supported without being separated to the outside relative to a conventional or different arrangement.

Also, the phenomenon in which the wire comes into contact with the surface of the control box having the relatively high temperature may be prevented.

Also, the compressor and the control components, which are the main heating sources of the air conditioner, may be cooled.

Also, the condensed water scattered by the operation of the blower fan may be prevented from being permeated into the control box.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A control box comprising:

a PCB assembly comprising a heat generation component and a heat dissipation plate, which are disposed at a bottom surface of a board;

a PCB support part supporting a lower portion of the board, the PCB support part having a support partition part that is disposed between the heat generation component and the heat dissipation plate; and a box case having an inner space that accommodates the support partition part and the heat generation component, wherein the heat dissipation plate is disposed outside the box case, and wherein the PCB support part comprises:

an upper part with an opened top surface;

a side part extending in a downward direction from the upper part; and a PCB coupling part disposed at an inner surface of the upper part and coupled to the board via a coupling member.

2. The control box of claim 1, wherein the PCB support part further comprises:

a first accommodation part that accommodates the heat generation component, the first accommodation part being disposed between the side part and the support partition part.

3. The control box of claim 2, wherein the box case comprises an opened case top part and a closed case bottom part, wherein the support partition part and the side part are disposed within the inner space through the case top part.

4. The control box of claim 3, wherein the support partition part extends in the downward direction from the top part, and the side part faces the support partition part.

5. The control box of claim 2, wherein the PCB support part further comprises a second accommodation part that accommodates the heat dissipation plate, and the first and second accommodation parts are partitioned by the support partition part.

6. The control box of claim 2, wherein the upper part comprises:

a first upper part that surrounds the heat generation component; and a second upper part that surrounds the heat dissipation plate, wherein the support partition part is disposed between the first and second upper parts.

7. The control box of claim 6, wherein the PCB coupling part is disposed at an inner surface of the first or second upper part and coupled to the board via the coupling member.

8. The control box of claim 7, wherein the inner surface of the first or second upper part further comprises a support rib extending therefrom to support the board.

9. The control box of claim 8, wherein the support rib comprises a vertical rib extending in a vertical direction up to a height of an upper end of the PCB coupling part to support a lower portion of the board.

10. The control box of claim 8, wherein the support rib comprises a horizontal rib extending in a horizontal direction to support an upper portion of the board.

11. The control box of claim 2, wherein a lead-out opening through which a wire connected to the PCB assembly is led out to the outside of the PCB support part is formed in the side part of the PCB support part.

12. The control box of claim 11, wherein a wire penetration part through which the wire led out through the lead-out opening is led out to the outside of the box case is provided in the box case.

13. The control box of claim 12, wherein the lead-out opening is formed by cutting the side part upward from a lower portion, and the wire penetration part is recessed in a downward direction from an upper portion of the box case.

14. The control box of claim 12, further comprising a wire guide disposed at an upper portion of the lead-out opening to guide the wire that is connected to the PCB assembly.

15. The control box of claim 2, wherein the box case is formed having a case heat releasing hole through which heat generated in the PCB assembly is released, and wherein the PCB support part comprises a cutoff part formed by cutting at least a portion of a surface facing the case heat releasing hole.

16. The control box of claim 2, further comprising a box cover that is coupled to an upper portion of the box case and covers the opened top surface of the PCB support part.

17. A window type air conditioner comprising the control box of claim 1.

18. The control box of claim 3, wherein the PCB support part coupled to the PCB assembly is seated on the case bottom part in the inner space of the box case.

19. A control box comprising:

a PCB assembly comprising a heat generation component and a heat dissipation plate, which are disposed at a bottom surface of a board;

a PCB support part supporting a lower portion of the board, the PCB support part having a support partition part that is disposed between the heat generation component and the heat dissipation plate; and a box case having an inner space that accommodates the support partition part and the heat generation component, wherein the heat dissipation plate is disposed outside the box case, wherein the PCB support part comprises:

an upper part with an opened top surface;

a side part extending in a downward direction from the upper part; and wherein the side part of the PCB support part includes a lead-out opening through which a wire connected to the PCB assembly is led out to the outside of the PCB support part.

* * * * *